US005765662A

United States Patent [19]

Mellen

[11] Patent Number: 5,765,662

[45] Date of Patent: Jun. 16, 1998

[54] WHEELED RAISE SKIP

[76] Inventor: James Mellen, P.O. Box 25, Silverton, British Columbia, Canada, V0G 2B0

[21] Appl. No.: 697,791

[22] Filed: Aug. 30, 1996

[51] Int. Cl.[6] ..... B66B 9/06

[52] U.S. Cl. ..... 187/245; 187/246; 299/12; 175/86

[58] Field of Search ..... 187/239, 245, 187/244, 246; 299/12, 13; 175/86; 182/82, 142

[56] References Cited

U.S. PATENT DOCUMENTS

| | | | |
|---|---|---|---|
| 3,016,989 | 1/1962 | Lindmark | 187/19 |
| 3,085,794 | 4/1963 | Johnsson et al. | 262/5 |
| 3,516,257 | 6/1970 | Van de Vegte | 61/45 |
| 3,516,258 | 6/1970 | Boland | 61/45 |
| 3,731,976 | 5/1973 | Granskog et al. | 299/18 |
| 3,830,338 | 8/1974 | Svensson | 182/82 |
| 4,132,276 | 1/1979 | Svensson | 173/1 |
| 4,960,175 | 10/1990 | Granskog | 175/86 |
| 4,986,374 | 1/1991 | Niemi et al. | 175/86 |

*Primary Examiner*—Joseph E. Valenza
*Assistant Examiner*—Khoi H. Tran
*Attorney, Agent, or Firm*—Antony C. Edwards

[57] ABSTRACT

A raise buggy has a storage and transport cabinet for storing and transporting equipment and material along an inclined raise, over an inclined raise floor extending between a base level and a raise face, wheels for rolling the cabinet over the raise floor in contact with the raise floor, the cabinet having a forward, inclined, generally planar primary work surface extending between an upper surface of the cabinet and a lower surface of the cabinet, inclined so as to be generally horizontal when the raise buggy has been elevated along the inclined raise floor by selective winching by cable means to a position adjacent and below the raise face.

13 Claims, 14 Drawing Sheets

WHEELED RAISE SKIP

FIELD OF THE INVENTION

This invention relates to the field of underground mining equipment and in particular to equipment for use in a raise, more particularly devices for conveying material and for providing a working platform within a raise.

BACKGROUND OF THE INVENTION

Underground mining often requires the driving of a raise. This means generally that an inclined tunnel, which may be inclined between 30 degrees and 90 degrees from the horizontal, is driven generally linearly from an underground base level. The linear driving of a raise requires that a raise face or rock face, which may be six foot by six foot square or otherwise as required, is drilled and blasted so as to extend a tunnel having a consistent cross section. The cross section thereby defines a tunnel floor, referred to as a footwall, side walls and a ceiling.

Conventionally, in order to assist miners climbing up the inclined raise to reach the raise face where the drilling and blasting is being performed, a linear steel-runged ladder is affixed as by bolts to the floor of the tunnel, generally in eight foot lengths. The ladder is lengthened as the raise face is driven linearly.

Also conventionally, once the drilling has been performed at the raise face, the miners' tools, instead of being carried down the raise to the safety of the base level, are left hanging on the walls of the raise and so are often damaged by flying blast rock. These tools, which are typically heavy, when damaged have to be repaired on site or removed for repair.

In the prior art, applicant is aware of U.S. Pat. No. 4,132,276 which issued to Svensson et al on Jan. 2, 1979 for an Arrangement for Forming Vertical and Steeply Inclined Shafts, which discloses a device intended for a vertical pilot shaft and specifically conveying miners down the shaft to a drill platform below. It is neither taught nor suggested, nor possible to use this device, in an inclined raise.

Applicant is also aware of U.S. Pat. No. 3,085,794 which issued to Johansson et al on Apr. 16, 1963 for a Raise Driving Apparatus. Johansson teaches a device on which a miner may ride consisting of a hoist cage, raised and lowered by a hoist cable, driven by an air motor within the cage, from a tunnel above the raise where the cable is lowered down through a pre-drilled bore hole and hooked to the hoist cage. The hoist cage may be advanced up the raise to the working area by means of the cable. Prior to blasting, the hoist cage must be lowered to the bottom of the raise, unhooked from the cable and the cable rewound so as to retract it into the tunnel above.

Applicant is also aware of U.S. Pat. No. 4,986,374 which issued to Niemi et al on Jan. 22, 1991 for an Apparatus for Driving an Upperly Directed Shaft in Rock, which applicant believes is otherwise known in the industry as an Alamac Raise Climber. The Niemi device operates from a suspended guide rail suspended from the ceiling of the shaft. The device is a highly mechanized raise climber carrying a single boom pneumatic drill and also adapted to convey miners along the shaft to the rock face.

Consequently, it is an object of the present invention, to provide a simple transportation mechanism in the form of a raise cart or buggy which may be elevated or lowered along the raise by a cable for conveying mining tools and material along the floor of the raise so as to transport them to the safety of the base level during blasting operations, and to re-transport them back to the face of the raise following blasting so that further drilling operations may be performed.

It is a further object of the present invention to provide wheels, tracks or the like on cart or buggy and a working surface on the cart or buggy so that the cart or buggy may be rolled along the raise floor to an elevated position where the working surface may serve as a drilling platform. The cable provides the means by which the cart or buggy may be selectively conveyed along the length of the raise so as to provide the working surface upon which miners may stand when drilling at the face of the raise.

In its preferred embodiments, it is also an object of the present invention to provide a buggy or cart having wheels, tracks or the like, that is, so that the cart or buggy does not require a rail system but rather may be linearly winched by the cable on the wheels or tracks, the cart or buggy also providing a tool locker and an explosives locker within an enclosure, and whereon the working surface is selectively inclinable so that depending on the incline angle of the raise, the working surface may be adjusted to the horizontal. These and further objects of the present invention will become apparent as will the preferred embodiments accomplishing these objects as disclosed in the detailed descriptions below.

SUMMARY OF THE INVENTION

The wheeled raise buggy of the present invention is a wheeled mining skip in the form of a buggy or cart. The raise buggy may, as a simplification, be described as a tool cabinet laid on its back and mounted on wheels, and adapted to be winched up an inclined raise by means of a cable attached to the uppermost end of the buggy and, by means of pulleys affixed to the uppermost end of the raise. The raise buggy may be returned to the base of the raise by detensioning the cable. A hoist at the base of the raise is used to tension or detension the cable depending on whether it is desired to elevate or lower the raise buggy along the raise. The raise buggy is used to carry heavy mining tools to the uppermost end of the raise where the raise buggy is secured to the side walls. A ratchet-like braking mechanism is provided to prevent the inadvertent backsliding of the buggy down the raise. The ratchet dogs of the braking mechanism engage the rungs of a steel ladder which, conventionally, is secured to the floor of the inclined raise to allow miners to climb up to the drilling site at the rock face.

In one aspect, the uppermost end of the raise buggy is also provided with a selectively inclinable platform which may be inclined so as to present a horizontal platform on which the miners may stand and rest their drilling tools. In a further aspect, the selectively inclinable drilling platform has folding flaps or the like which may be folded outward from a configuration whereby they are stored on the uppermost end of the buggy so as to provide a drilling platform having an increased surface area on which to stand.

The use of the raise buggy is advantageous in that, once holes have been drilled in the raise face in preparation for blasting, the miners can then exit from the raise and remove their tools, with the exception of the steel ladder, completely from the tunnel so that blast rock falling from the blast does not damage equipment. In the past, the tools have been left hanging from the side walls in the uppermost end of the raise during a blast. As the raise is advanced by drilling and blasting operations, the steel ladder is extended along the newly formed raise floor and new rock anchors secured in the newly uncovered uppermost end of the raise to secure the cable pulleys.

In summary the raise buggy of the present invention comprises a storage and transport cabinet for storing and transporting equipment and material along an inclined raise, over an inclined raise floor extending between a base level and a raise face, means for rolling the cabinet over the raise floor in contact with the raise floor, where the cabinet has a forward, inclined, generally planar primary work surface extending between an upper surface of the cabinet and a lower surface of the cabinet, inclined so as to be generally horizontal when the raise buggy has been elevated along the inclined raise floor by selective winching by cable means to a position adjacent and below the raise face. Advantageously the forward, inclined, generally planar primary work surface is a drilling platform selectively rotatable relative to the cabinet.

The primary work surface may also be elevatable by means for selective elevating relative to the cabinet, either simultaneously with, or independent of, the rotation of the primary work surface relative to the cabinet. Rotation may be accomplished by, at one end of the drilling platform, hinge means mounted to the cabinet and at an opposed end of the drilling platform, releasable securable rigid arms, releasable securable between the drilling platform and the cabinet for selective positioning of that end of the drilling platform relative the cabinet. Alternatively, this may be accomplished by hydraulic actuating means at one or both ends of the drilling platform.

In one aspect, the present invention further comprises cable means extending from the cabinet to the raise face so as to be threadable through, for turning around, a block mounted to the inclined raise floor adjacent the raise face for return of the cable means to the base level whereby the cable means may be selectively tensioned and detensioned by hoist means engaging the cable means.

In a further aspect of the present invention, the means for rolling said cabinet over the raise floor in contact with the raise floor comprises laterally opposed pairs of fore and aft wheels rotatably mounted on the cabinet so as to extend beneath the cabinet in rolling contact with the raise floor, and wherein the fore pair of laterally opposed wheels are pivotable relative to the cabinet so as to steer the cabinet by steering means attached to the cable means where the cable means extends from the cabinet to the block adjacent the raise face.

In a further aspect of the present invention the cabinet further comprises at least one laterally opposed pair of generally horizontally extending bumper means extending laterally outwardly from the cabinet so as to extend between the cabinet and opposed walls of the raise.

In a further aspect of the present invention the bumper means comprises laterally opposed pair of wheels adapted for rotation about generally vertical axes of rotation.

In a further aspect of the present invention the drilling platform comprises a primary platform corresponding in dimension to cross-sectional dimensions of the cabinet and platform extensions selectively extendable from the primary platform so as to provide an extended generally planar drilling platform extending substantially a cross-sectional distance between the side walls of the raise and substantially between the raise floor and a raise ceiling.

In a further aspect of the present invention the selectively extendable drilling platform extensions are hingedly mounted to the primary drilling platform for rotation from a storage position folded onto and lying upon the primary drilling platform and an open position adjacent to and generally co-planar with the primary drilling platform.

In a further aspect of the present invention the selectively extendable drilling platform extensions are selectively extendable rigid members on which may be laid scaffolding members.

DETAILED DESCRIPTION OF THE PREFERRED EMBODIMENTS

Figure 1:
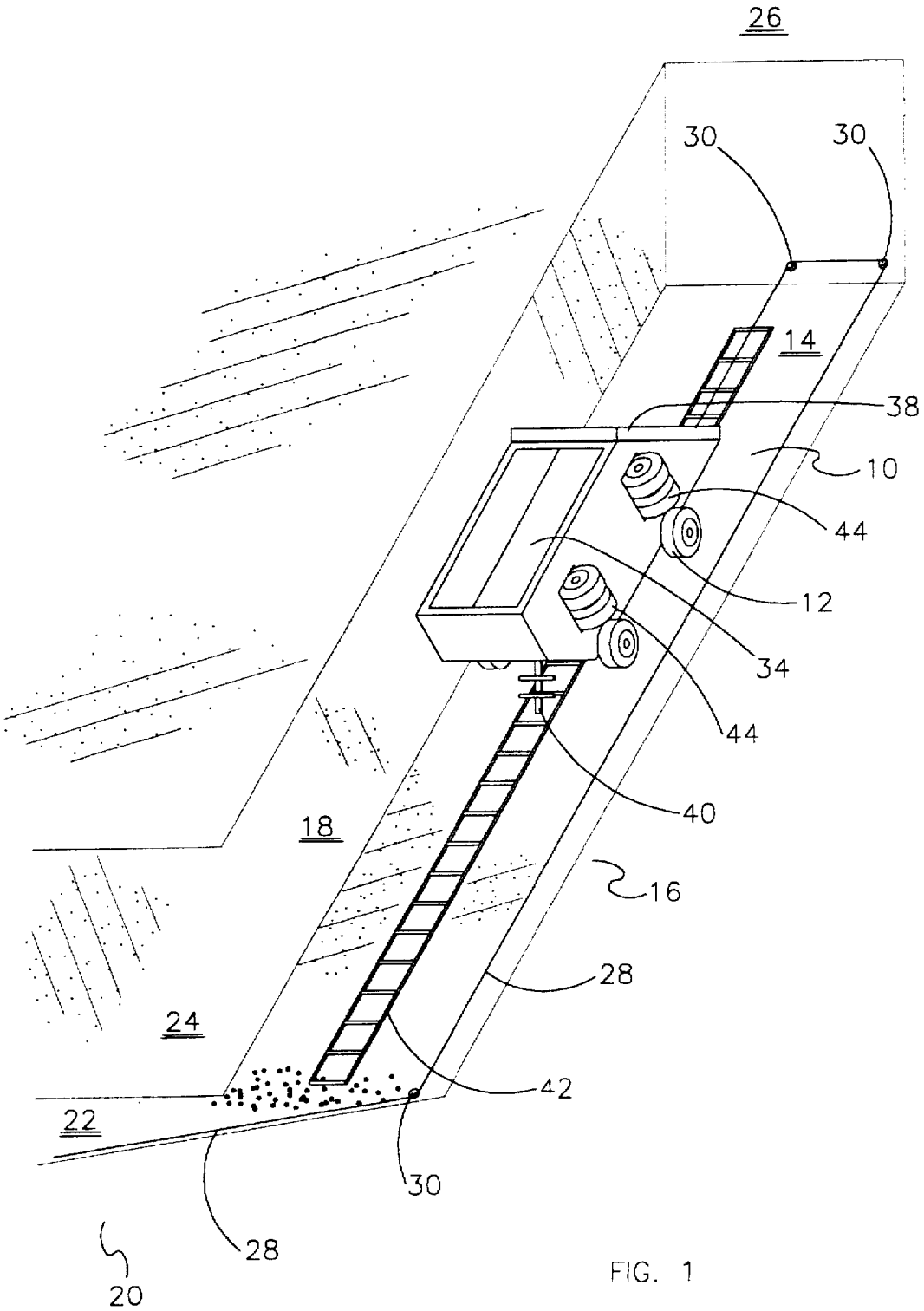
FIG. 1 is, in cut-a-way perspective view, an inclined raise in which a raise buggy of the present invention is being conveyed.

As illustrated in FIG. 1, raise buggy 10 has wheels 12 so that raise buggy 10 may be elevated and lowered along inclined floor 14 of raise 16. Raise 16 has opposed side walls 18, only one of which is illustrated in FIG. 1, the other having been cut-away for clarity. Raise 16 extends between tunnel 20 having tunnel floor 22 and tunnel side walls 24, and rock face 26.

Figure 2:
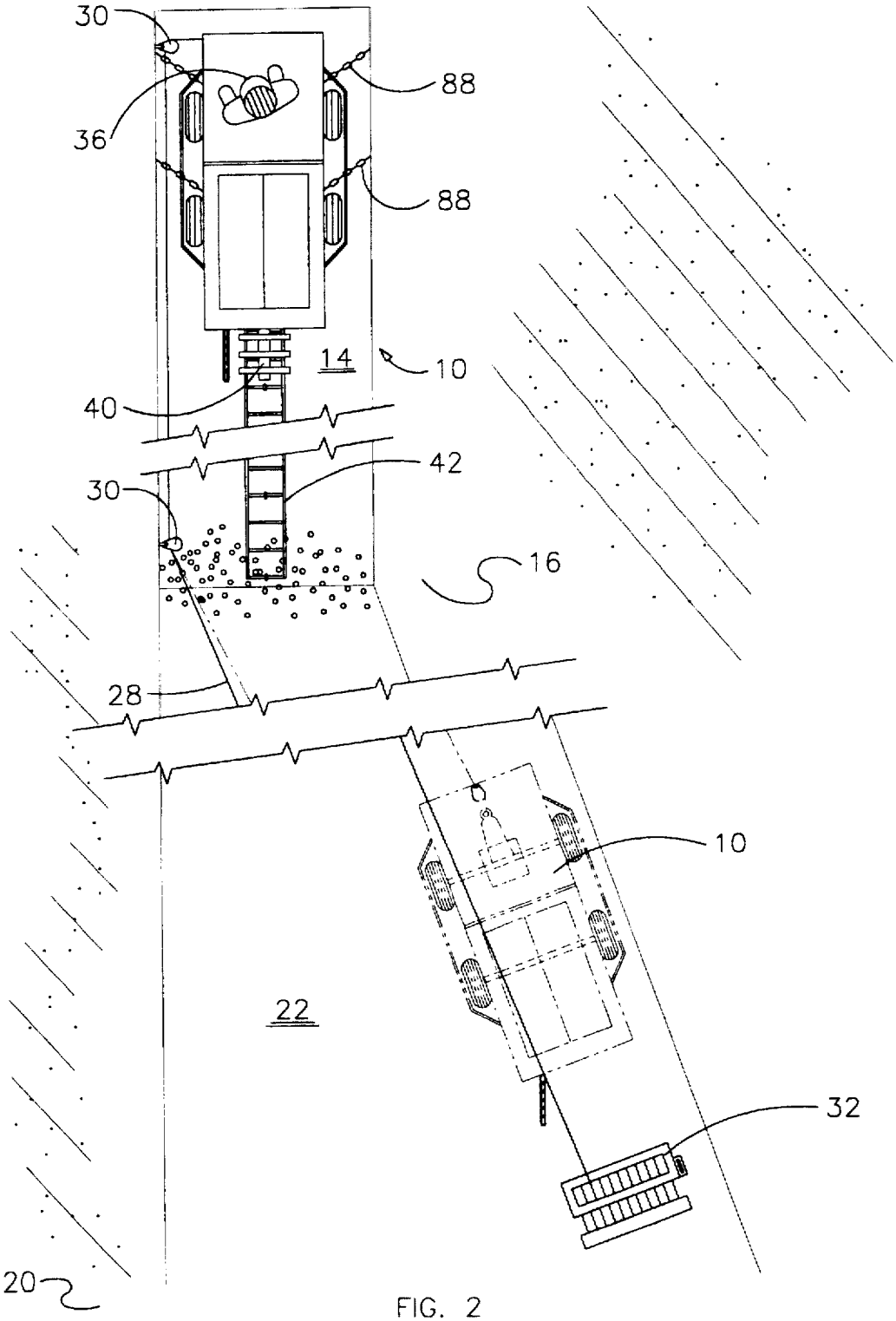
FIG. 2 is, in cut-a-way plan view, a tunnel and raise in which the raise buggy of the present invention is illustrated, for diagrammatic purposes, simultaneously in both a lowered position and an elevated position.
Figure 3:
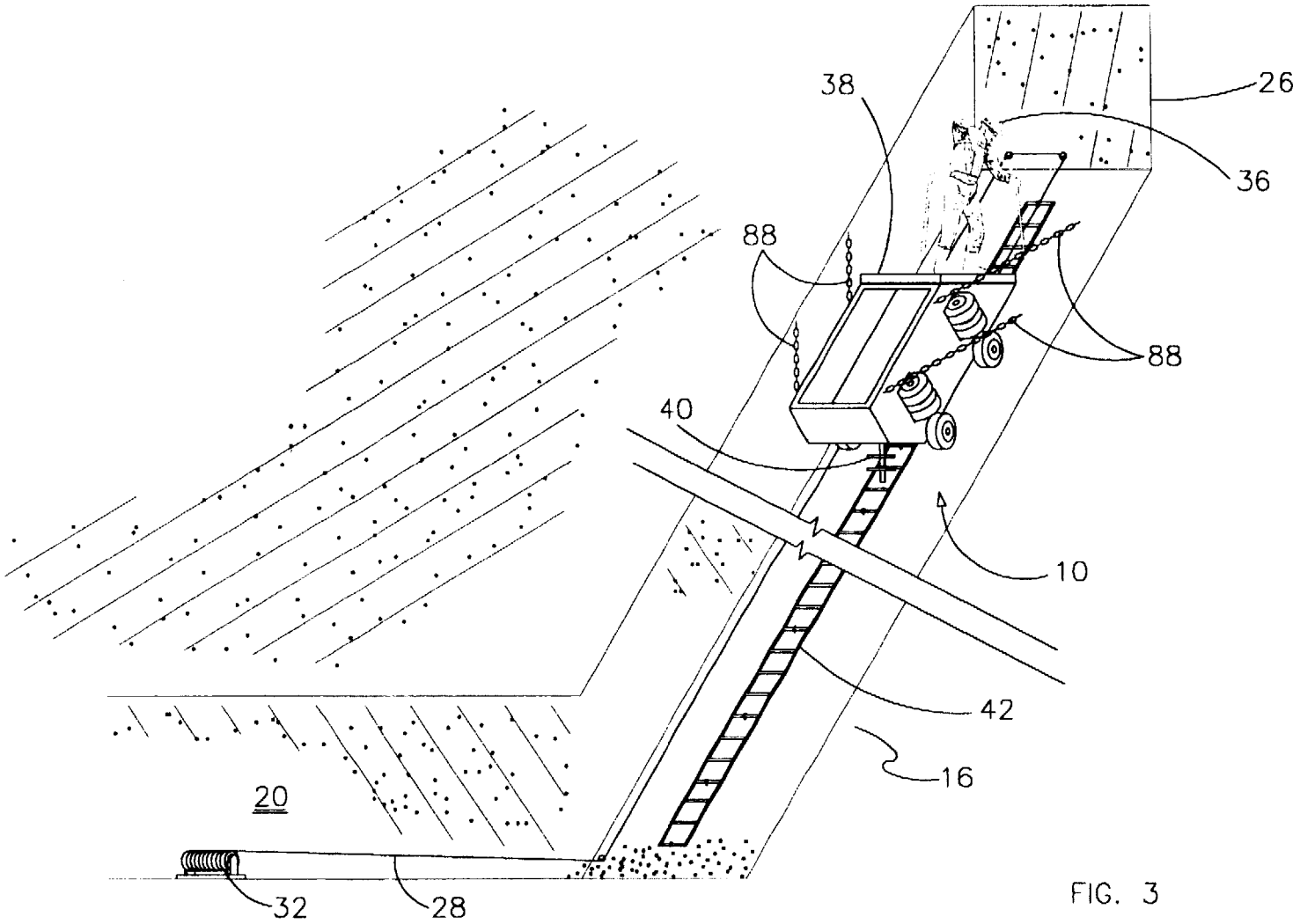
FIG. 3 is the view of FIG. 2 illustrating miners standing on an extended drilling platform 8.

Raise buggy 10 is elevated and lowered along raise 16 by means of cable 28 running in blocks 30. Cable 28 may be tensioned so as to elevate raise buggy 10 along raise 16 or may be detensioned so as to lower raise buggy 10 along raise 16 by means of a conventional tugger hoist 32, not shown in FIG. 1 but seen in FIGS. 2 and 3, which device is known in the art.

Raise buggy 10 is provided with doors 34 which provide access to the interior cavity of raise buggy 10 wherein may be stored tools, explosives or like equipment and material, whether in lockers or otherwise, required for drilling and blasting operations at rock face 26 by miners 36 standing on drilling platform 38.

Ratchet bar 40 is mounted, as by a hinge means, to the lower end of raise buggy 10 so that ratchet bar 40 is free to drop down between the rungs of ladder 42 as raise buggy 10 is elevated along raise 16. Ratchet bar 40 dropping down between the rungs of ladder 42 acts, in the manner of a ratchet dog, to prevent raise buggy 10 from inadvertently rolling backwards down raise 16. As described above, ladder 42 is conventionally bolted as by rock anchors to inclined floor 14 and is extended along inclined floor 14 as raise 16 is lengthened by drilling and blasting of rock face 26.

In one preferred embodiment, horizontally aligned wheels 44 or bumpers or the like are provided on both sides of raise buggy 10 to prevent raise buggy 10 from jamming as it is being raised or lowered in the event that raise buggy 10 does not remain centered on a longitudinal center line along raise 16 and contacts a side wall 18. In the preferred embodiment, horizontal wheels 44 are rotatably mounted about vertical axes as by vertically mounted shafts.

In alternative embodiments, wheels 12, which are free to rotate about generally horizontal laterally aligned parallel axles in a conventional manner, may be replaced by other forms of wheels or tracks so long as raise buggy 10 is free to roll along inclined floor 14 without the need for running on, or guidance by, tracks or rails.

Figure 4:
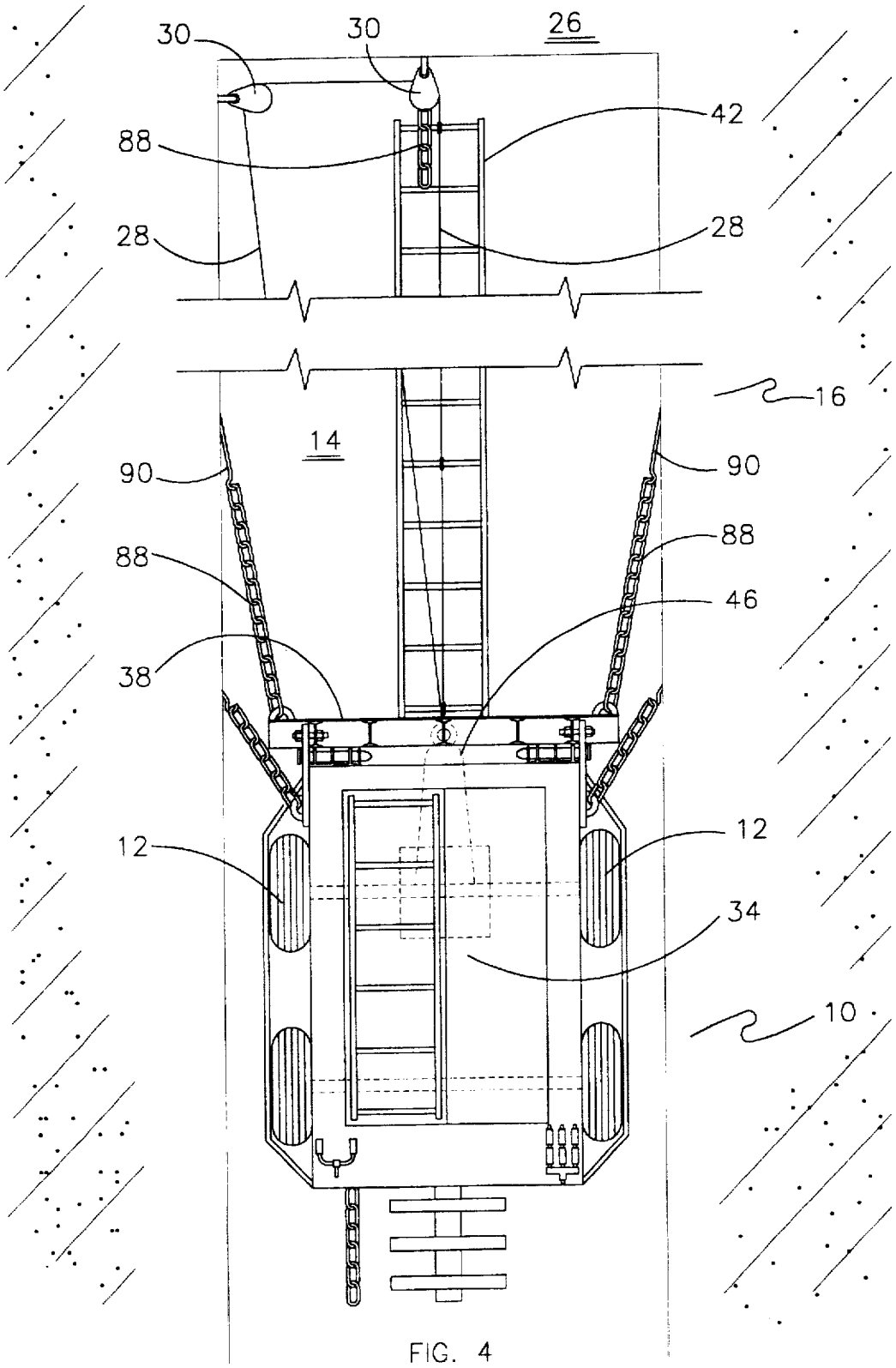
FIG. 4 is, in cut-a-way plan view, the raise buggy of the present invention in transport along the raise.
Figure 5:
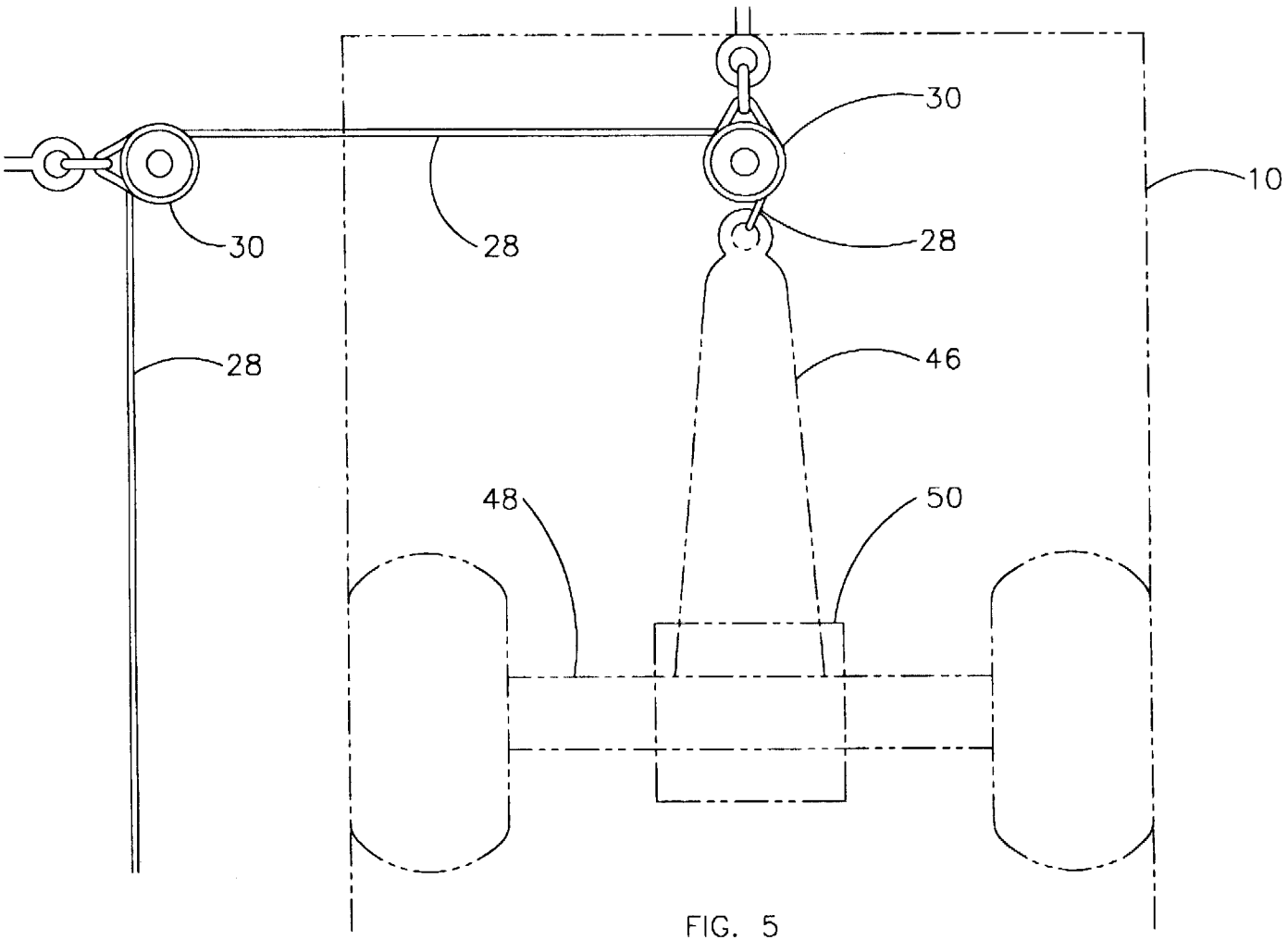
FIG. 5 is, in a view looking upwards from underneath the forward end of the raise buggy of the present invention, the steering draw bar snugged against the center line block at the foot wall beneath the raise face.
Figure 6:
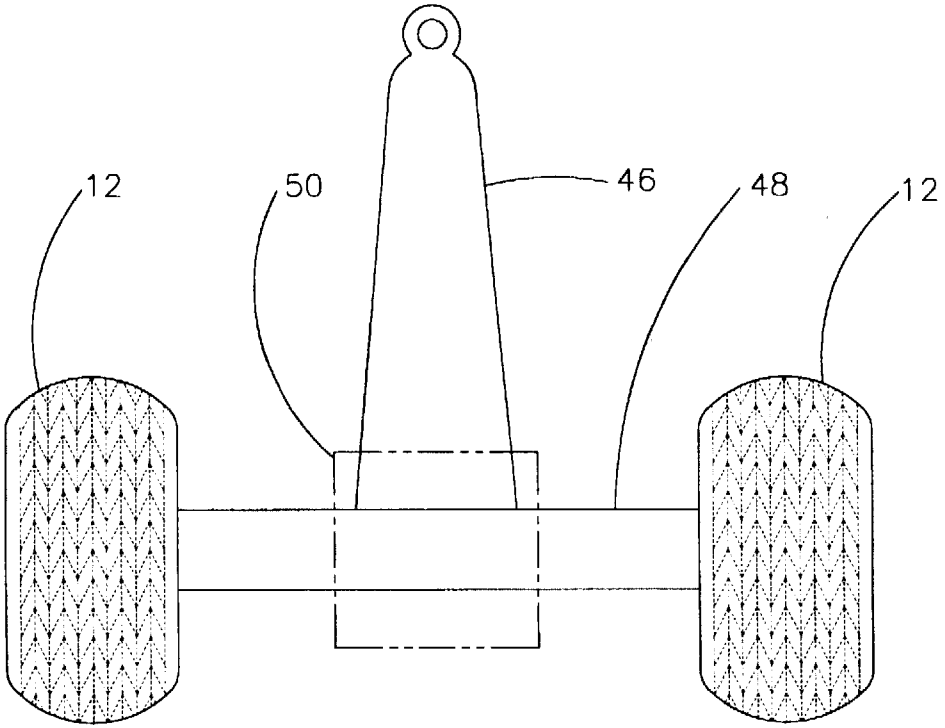
FIG. 6 is, in cut-a-way plan view, a draw bar, steering box and front wheel and axle components of the raise buggy of the present invention.
Figure 7:
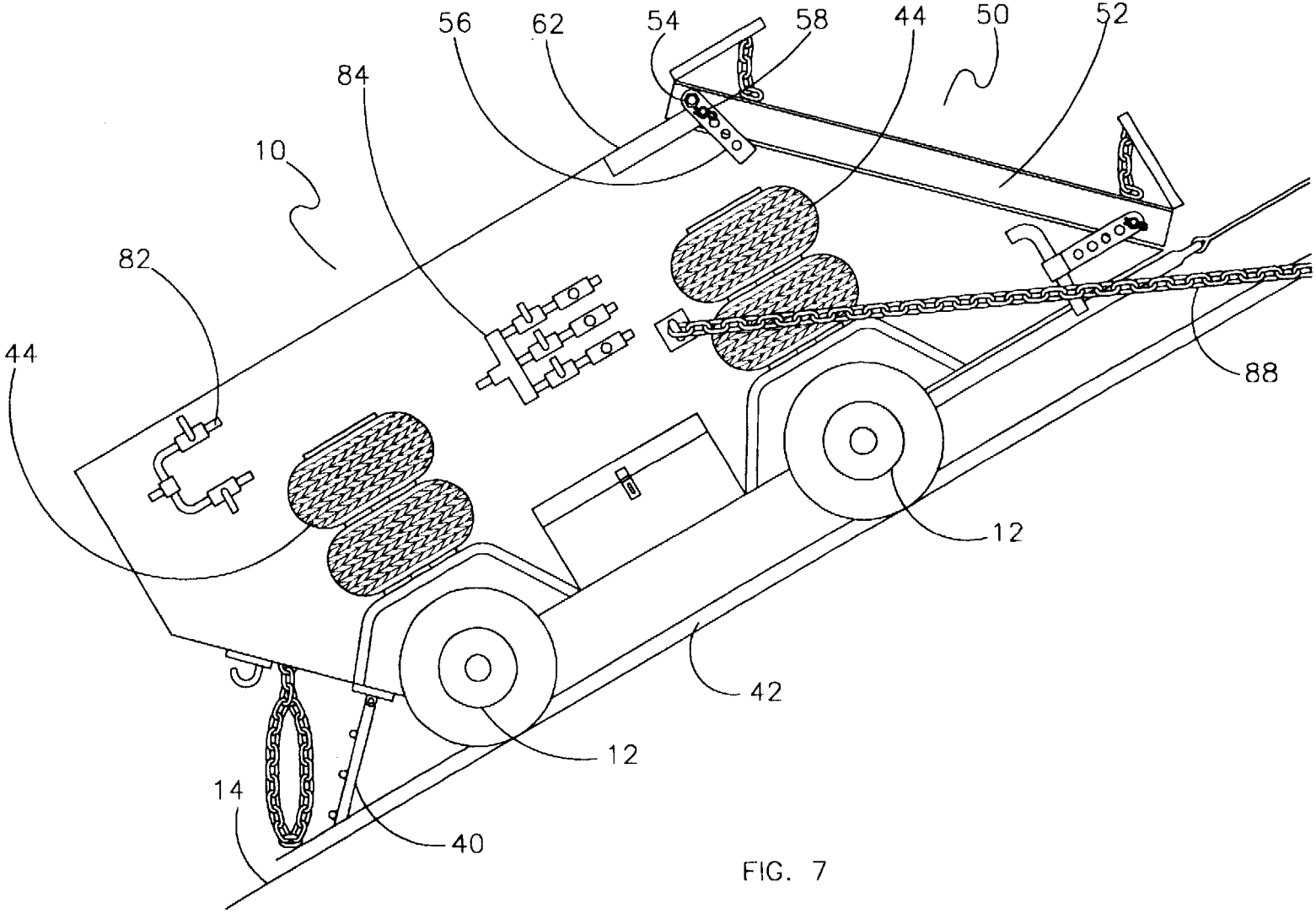
FIG. 7 is, in side elevation view, the raise buggy of the present invention.
Figure 8:
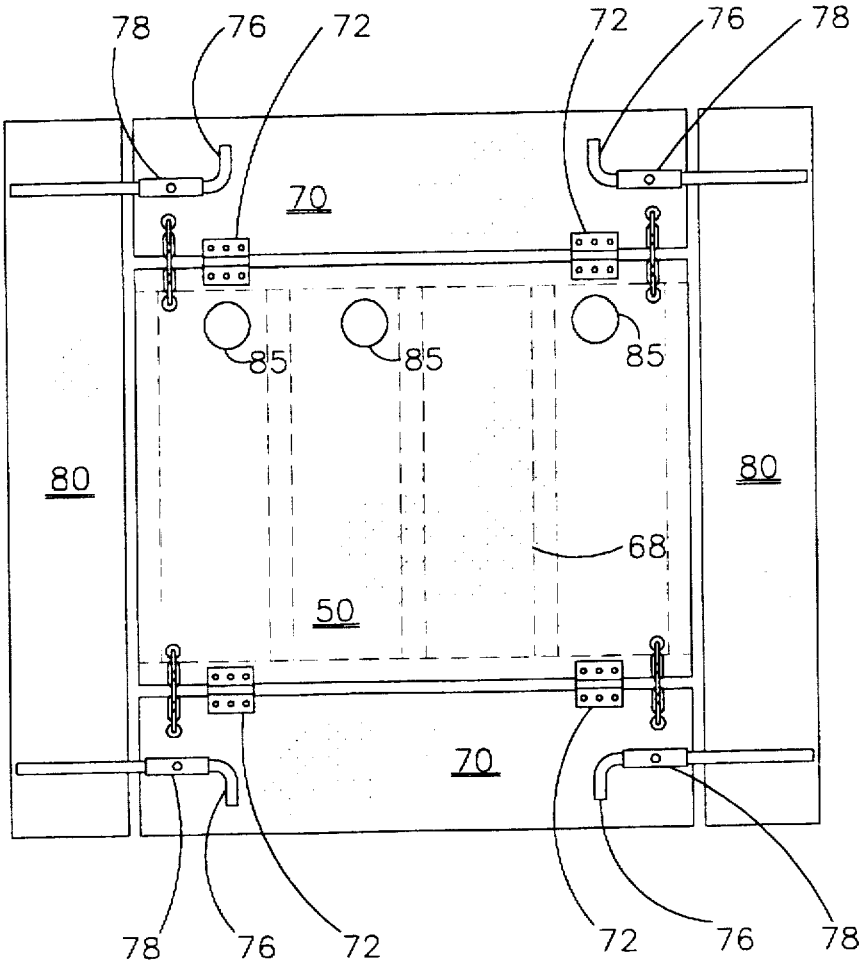
FIG. 8 is, in plan view, the drilling platform of the raise buggy of the present invention.

In the preferred embodiment, the front pair of wheels 14, that is the pair of wheels 14 at the upper end of raise buggy 10 as raise buggy 10 is being elevated or lowered along raise 16, are pivotable in unison about a central vertical axis in the manner of conventional draw bar steering by means of draw bar 46 seen in FIG. 4 and illustrated in better detail in FIGS. 5 and 6. Thus as seen in FIG. 6, wheels 12 are rotatably mounted on axle 48 and the turning or pivoting of wheels 12 about vertical axes may be controlled by draw bar 46 acting on steering box 50.

Figure 9:
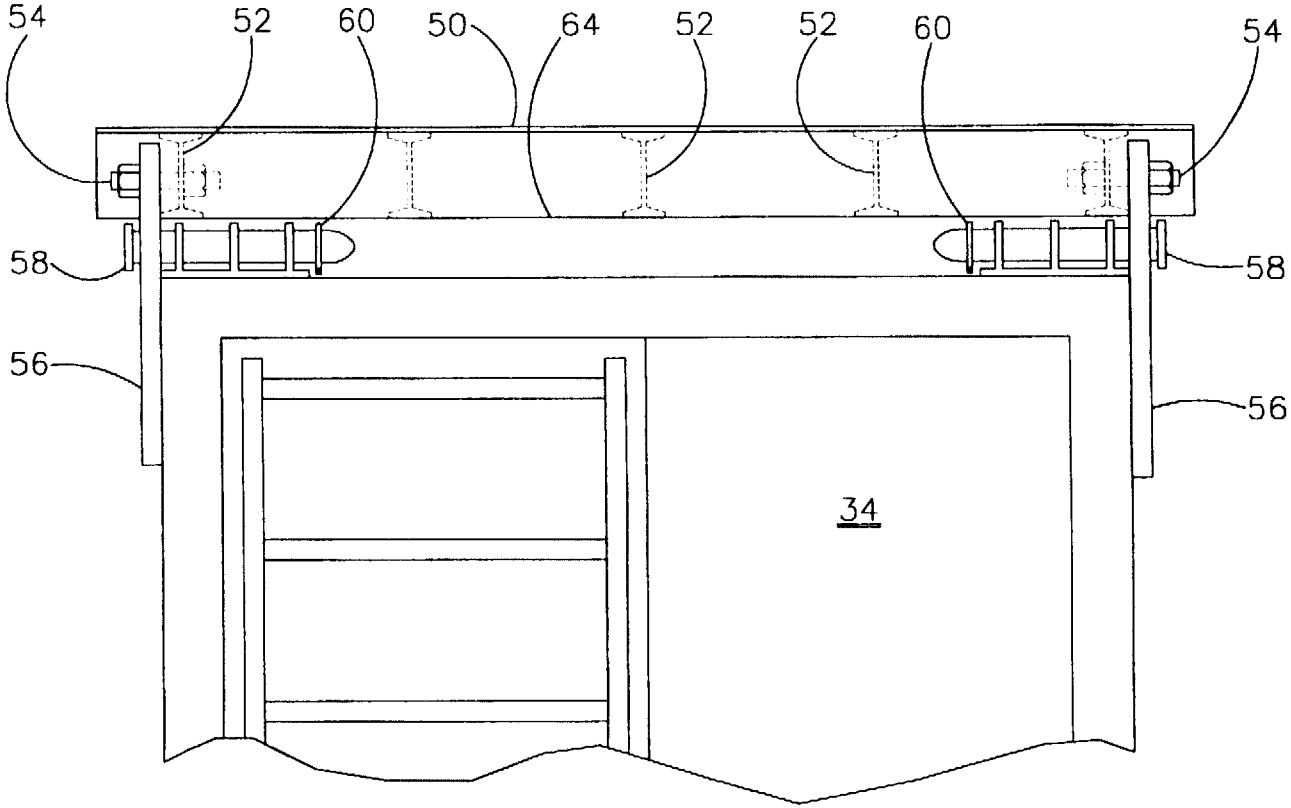
FIG. 9 is, in partial cut-a-way view, the mounting arrangement of the drilling platform onto the front face of the raise buggy of the present invention.
Figure 10:
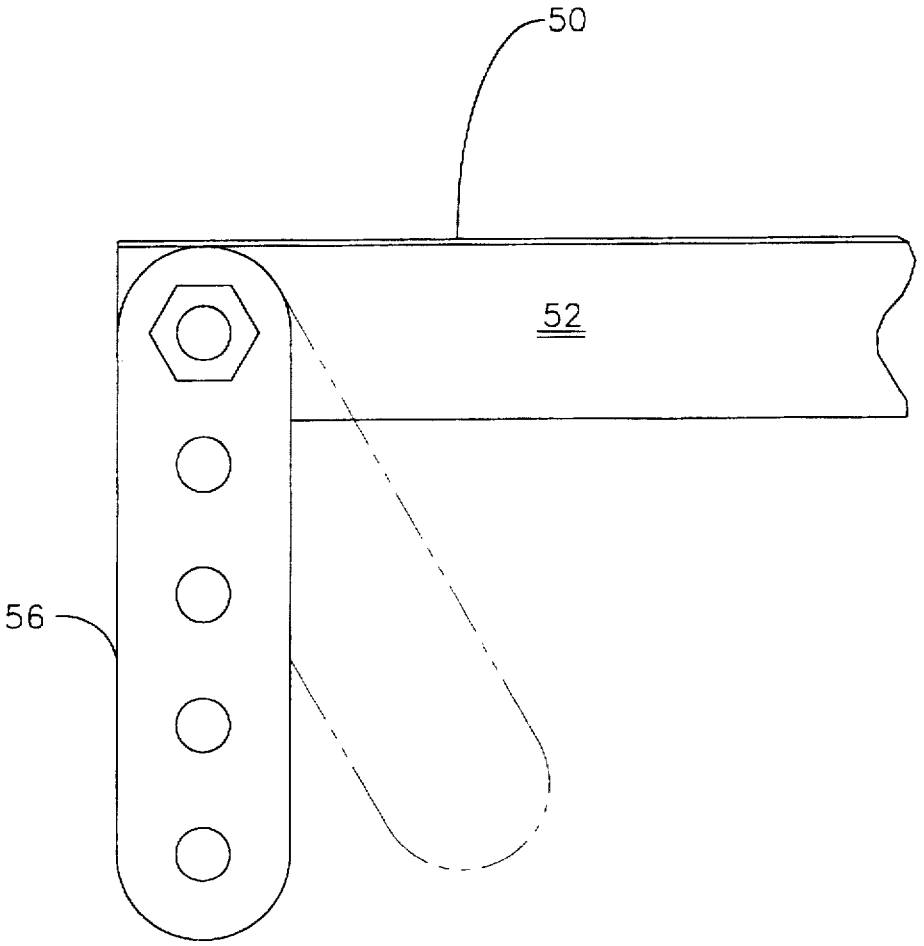
FIG. 10 is, in cut-a-way side elevation view, the drilling platform mounting arm of the raise buggy of the present invention.
Figure 11:
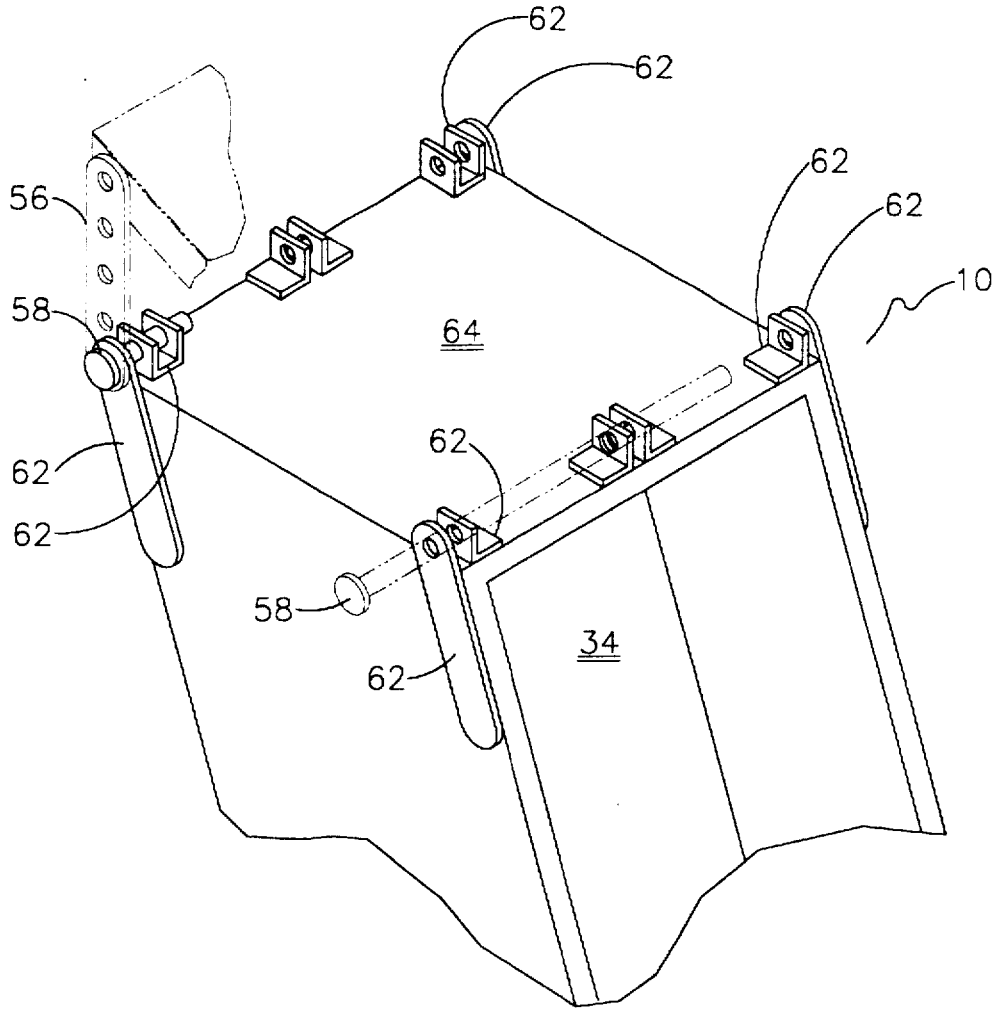
FIG. 11 is, in partial cut-a-way perspective view, the front face of the raise buggy of the present invention with the drilling platform removed.

As best seen in FIGS. 7–13, drilling platform 38 may be selectively inclinable so as to provide a horizontal working surface. Drilling platform 38 may fold outwardly to provide a larger working area than that provided on the front face of raise buggy 10. The primary work surface 50 covering the front of raise buggy 10 may be supported on pivotally mounted rigid members such as I-beams 52. I-beams 52 may be pivotally mounted to raise buggy 10 by means of hinge bolts 54, laterally and generally horizontally aligned and secured in place as best seen in FIG. 9. Arms 56, which may be of steel or like rigid material, and which may have an array of apertures therealong as seen in FIG. 10, may be provided so that I-beams 52 may be selectively elevated or rotated relative to raise buggy 10. Arms 56 may be secured relative to raise buggy 10 by means of pins or rods 58 secured by cotter pins 60 and journalled through the apertures in arms 56 and corresponding aperture members 62 rigidly mounted to the front face 64 of raise buggy 10, rigidly mounted by welding or the like.

Figure 12:
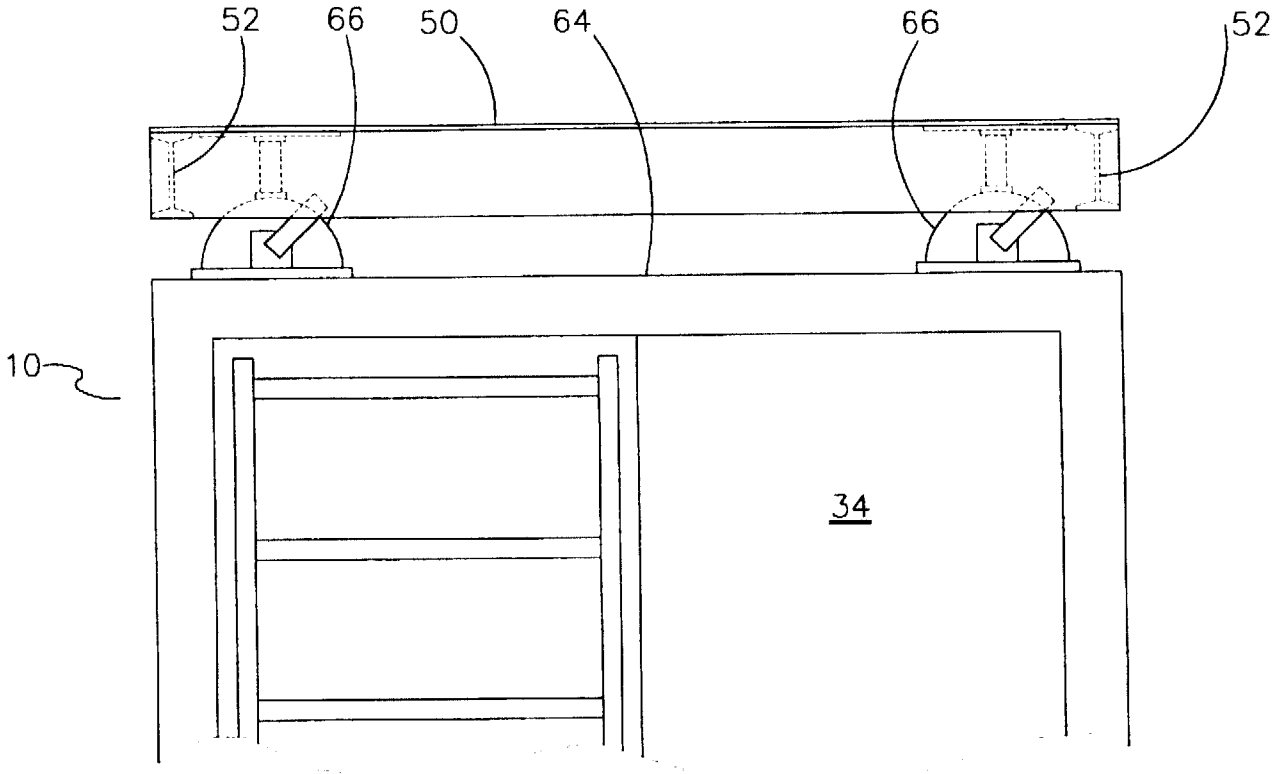
FIG. 12 is, in partial cut-a-way plan view, an alternative embodiment of the mounting arrangement of the drilling platform to the front face of the raise buggy of the present invention.

In an alternative embodiment illustrated in FIG. 12, I-beams 52 and primary work surface 50 may be selectively elevated and rotated relative to raise buggy 10 by means of hydraulic actuators or jacks 66 instead of arms 56.

Primary work surface 50, which advantageously is covered by screen mesh 68 to provide a non-slip work surface, in a preferred embodiment has folding work surface extensions 70, mounted as by hinges 72 so as to be foldable outwardly from a storage position laid flat over primary work surface 50. Folding work surface extensions 70, once folded outwardly from primary work surface 50, are adapted as by the use of hinges 72 and also by, for example, chains 74, to provide planar extensions of primary work surface 50, co-planar with primary work surface 50.

Further advantageously, selectively extendable means for supporting lateral scaffolding may be provided, and in a preferred embodiment, may simply be selectively extendable bolts or rods 76 slidingly supported within collars 78. Collars 78 may be rigidly mounted to folding work surface extensions 70 so that, with folding work surface extensions 70 folded outwardly from primary work surface 50, and with bolts or rods 76 extended laterally outward of folding work surface extensions 70, scaffolding 80, which may be planks or the like, may be laid over or otherwise mounted on to the portions of bolts or rods 76 extending laterally outward of folding work surface extensions 70 and primary work surface 50. Advantageously, folding work surface extensions 70 and scaffolding 80 is of an appropriate size so that, in conjunction with primary work surface 50, drilling platform 38 extends horizontally substantially the entire width of raise 16 between side walls 18 and extends substantially the entire distance between inclined floor 14 and the ceiling of the raise. In this fashion, the risk of a miner 36 falling from drilling platform 38 during drilling operations or the like, is reduced. Because scaffolding 80 is easily removed or merely moved to one side, access is still provided to doors 34 and, for example, to water headers 82 and air headers 84 which, further advantageously, may be mounted to a side of raise buggy 10.

In one preferred embodiment, primary work surface 50, which may be of planking or the like laid over I-beams 52, may have apertures 85 therein, supporting appropriately sized pipes or pots, for storing therein stoppers, drill steel or like tools and material required for drilling and blasting operations. If the apertures 85 in primary work surface 50 are pipes or holes then advantageously corresponding pots may be welded to the floor of the interior cavity of raise buggy 10 for supporting the ends of, for example, drill steel passed through the apertures 85 in primary work surface 50.

Figure 13:
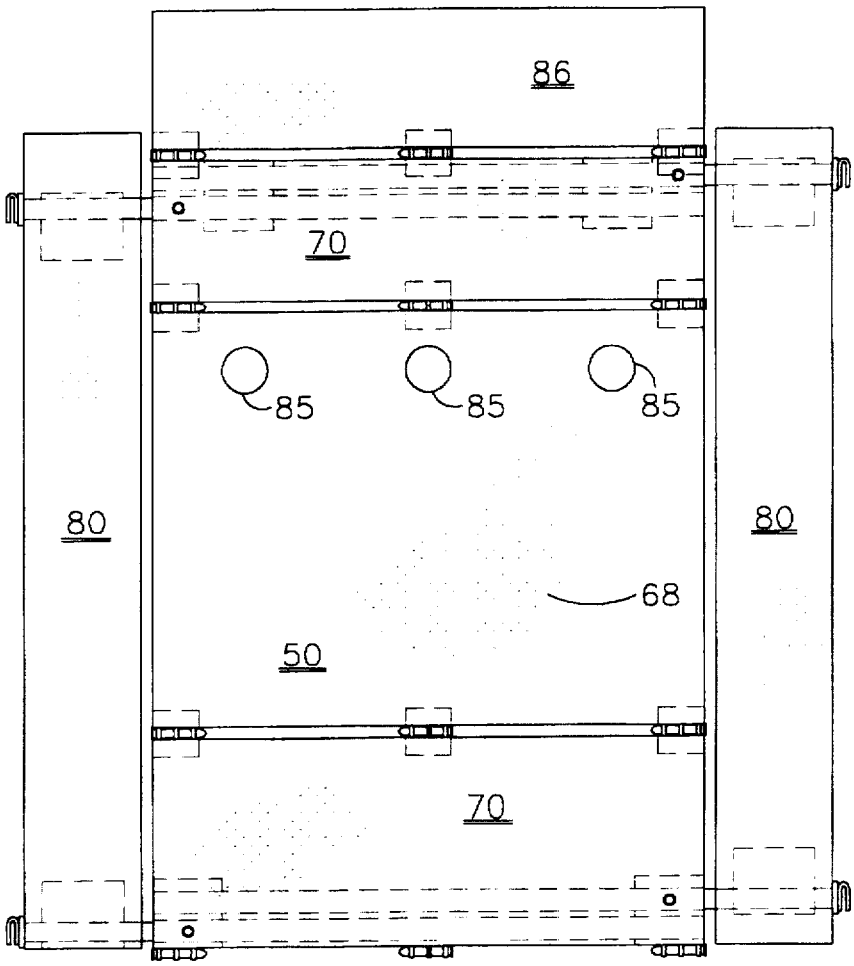
FIG. 13 is, in plan view, an alternative embodiment of the drilling platform of the raise buggy of the present invention.

In a further preferred embodiment as illustrated in FIG. 13, the folding work surface extension 70 on the side of primary work surface 50 closest to incline floor 14, may have a further outwardly foldable flap 86, which may be rigid, or semi-rigid adapted to lay flush against inclined floor 14 so as to prevent inadvertently dropped equipment and material falling down raise 16.

In operation, it must be kept in mind that the design of the present invention provides a drilling skip in the form of raise buggy 10 for linear driving of raises when the raise is inclined, for example, in excess of 30 degrees, to such a degree that transport of tools and material is difficult and hazardous typically requiring the use of ladder set in the floor of the raise. In the operation of the present invention, it is assumed that miners 36 at the face of the raise have means for communicating, such as by way of radio, with a miner at the lowermost end of the raise 16 or in tunnel 20 whose job it is to operate the tugger hoist.

Advantageously, tugger hoist 32 should be of 5 horsepower or larger, although the transport speed of raise buggy 10 will be slow, approximating a gentle walking speed, for example 1 or 2 miles per hour. Blocks 30 should be 6 inch heavy duty idler blocks supported by ¾ inch heavy duty eye-bolts. Cable 28 should advantageously be at least ⅝ inch steel core cable. Ladder 42 should be made of 1 inch type or steel advantageously in 8 foot lengths. Additionally, ladders may be provided over doors 34 and along ratchet bar 40 to provide a miner easy foothold for climbing onto raise buggy 10. Sections of ladder 42 may be chained at their top and bottom to rock anchors so as to be in a straight line along the center line of raise 16, and after each drilling and blasting cycle, miners 36 should survey the center line of raise 16 before raise buggy 10 is elevated up the raise.

Figure 14:
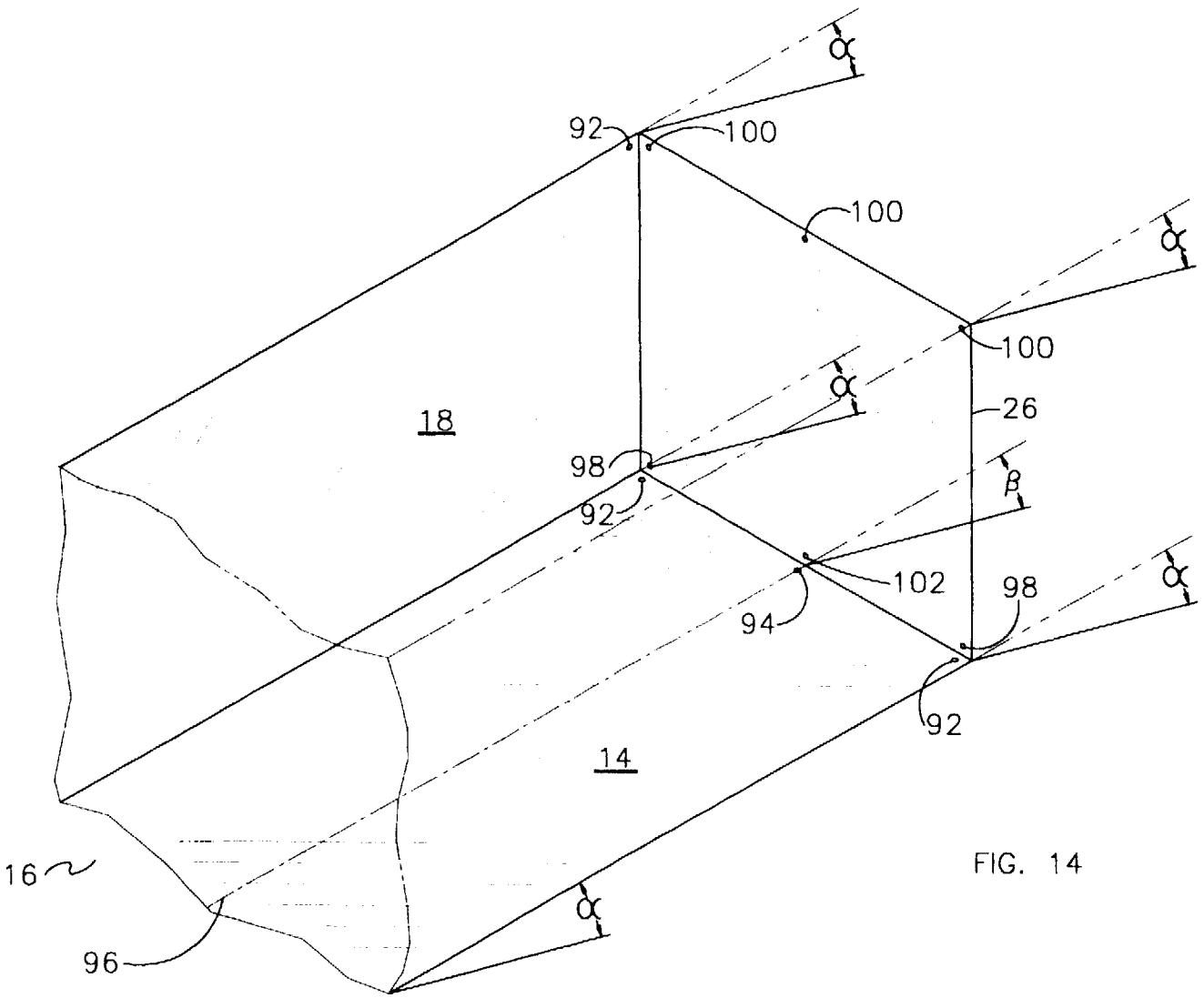
FIG. 14 is, in a perspective diagramatic view, the orientation of the drill holes at the raise face.

As best seen in FIG. 14, advantageously, four corner eye-bolt holes 92 may be drilled in rock face 26, one in each corner of rock face 26 and one center-line eye-bolt hole 94 is drilled in the foot wall (i.e. floor 14) beneath rock face 26 on the center line 96 of inclined floor 14. If angle $\propto$ denotes the angle formed between inclined floor 14 and the horizontal (i.e. the grade), then side lifter holes 98 and back holes 100 are also drilled so as to form the same angle $\propto$ to the horizontal (although back holes 100 may conventionally be drilled at a slightly larger angle than angle $\propto$ to the horizontal). In this fashion, the grade of inclined floor 14 is kept constant as raise 16 is extended. However, center-line lifter hole 102 should be drilled approximately 3 degrees less (as denoted by angle $\beta$) than the grade of inclined floor 14 to ensure a good lift in the rock during blasting, thereby forming a lip and making it easier to drill the center line eye-bolt hole 94 in the foot wall 14 beneath rock face 26, to thereby align raise buggy 10 with center line 96 so that raise buggy 10 may be elevated and lowered without hitting side walls 18.

Once drilling has been completed, and before blasting, when the miners are ready to lower raise buggy 10, the miner at the top of the raise should hang a new temporary ladder to stand on and all loose chains should be secured. Safety chains 88, while raise buggy 10 is in its elevated position in raise 16, are secured between raise buggy 10 and side walls 18 so as to prevent raise buggy 10 inadvertently slipping. Also while raise buggy 10 is in its elevated position in raise 16, the tugger hoist should be secured by, for example, a brake with chain and lock, including turning of and securing the air supply to the tugger hoist to avoid inadvertent triggering of the hoist.

For lowering raise buggy 10, safety chains 88 are released and ratchet bar 40 raised so that cable 28 may be detensioned allowing raise buggy 10 to roll backwards down raise 16. Safety chains 88 may be secured to side walls 18 by J-bolts 90.

Advantageously, in the case of blasting 8 foot rounds, it is important to elevate raise buggy 10 as far up as possible so as to snug as closely possible to block 30 on the center line of raise 16. In a preferred embodiment, drilling platform 38 extends forwardly of raise buggy 10 so as to extend over drawbar 46 and over centre-line block 30 when drawbar 46 is snugged against centre-line block 30. The extent that drilling platform 38 extends forwardly of raise bugging 10, and the corresponding length of drawbar 46 should be sufficient so that when the forward edge of drilling platform 38 is brought into proximity with the footwall, that is, with inclined floor 14, at the upper end of the raise adjacent the raise face 26, that a sufficient distance is left between drilling platform 38 and raise face 26 for the miners to hold therebetween their drills and related equipment, which, to be consistent with this disclosure, would be a distance of 8 feet.

As raise buggy 10 is being lowered following a raise round, once the raise round has been drilled, loaded and ready to blast, then: one of the miners descends the raise to tugger hoist 32 in tunnel 20, the miner left at the top of the raise 16 dismantles all safety chains and all safety dogs such as ratchet bar 40 and stands clear on a newly installed temporary ladder and passes instructions down to the miner at tugger hoist 22, the miner at the tugger hoist lowers raise buggy 10 on cables 28, the miner still at the upper end of the raise 16 removes the center block 30 and hangs it with the adjacent block 30 on side wall 18, and cables 28 are hung on J-bolts previously installed at earlier raise faces as the miner descends the raise to prevent cable damage during blasting.

If, as an example, raise 16 has to be driven 200 feet, then the length of cable 28 on the drum of tugger hoist 32 should advantageously be 500 feet of non-spliced cable. Drilling platform 38, may be used, as raised buggy 10 is elevated in raise 16, to carry large equipment to each level for example slushers and fans.

In order to remove raise buggy 10 from raise 16 prior to blasting, advantageously raise buggy 10 is pulled into tunnel 20. This may be accomplished, for example, by extracting slack cable from tugger hoist 32 and attaching the cable to a hook or the like provided at the rear of raise buggy 10 for that purpose and then tightening the cable so as to pull raise buggy 10 into tunnel 20 over the intersection between raise 16 and tunnel 20 which, advantageously, will be a short ramp formed from previous blast rock left for that purpose. Raise buggy 10 should be pulled into tunnel 20 a sufficient distance to allow the blast rock to be removed from the bottom of raise 16 following blasting.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A raise buggy comprising a storage and transport cabinet for storing and transporting equipment and material along an inclined raise, between opposed side walls, over an inclined raise floor extending between a base level and a raise face, means for rolling said cabinet over said raise floor in contact with said raise floor, said cabinet having a forward, inclined, generally planar primary work surface extending between an upper surface of said cabinet and a lower surface of said cabinet, inclined so as to be generally horizontal when said raise buggy has been elevated along said inclined raise floor by selective winching by cable means to a position adjacent and below said raise face.

2. The raise buggy of claim 1 wherein said forward, inclined, generally planar primary work surface is a drilling platform selectively rotatable relative to said cabinet about hinge means mounted to said cabinet and to said drilling platform for selective rotation of said drilling platform about a generally horizontal laterally extending axis of rotation.

3. The raise buggy of claim 2 further comprising means for selectively elevating said drilling platform relative to said cabinet.

4. The raise buggy of claim 2 further comprising cable means extending from said cabinet to said raise face so as to be threadable through, for turning around, a block mounted to said inclined raise floor adjacent said raise face for return of said cable means to said base level whereby said cable means may be selectively tensioned and detensioned by hoist means engaging said cable means.

5. The raise buggy of claim 4 wherein said means for rolling said cabinet over said raise floor in contact with said raise floor comprises laterally opposed pairs of fore and aft wheels rotatably mounted on said cabinet so as to extend beneath said cabinet in rolling contact with said raise floor, and wherein said fore pair of laterally opposed wheels are pivotable relative to said cabinet so as to steer said cabinet by steering means attached to said cable means where said cable means extends from said cabinet to said block adjacent said raise face.

6. The raise buggy of claim 5 wherein said cabinet further comprises at least one laterally opposed pair of generally horizontally extending bumper means extending laterally outwardly from said cabinet so as to extend between said cabinet and said opposed side walls of said raise.

7. The raise buggy of claim 6 wherein said bumper means comprises laterally opposed pair of wheels adapted for rotation about generally vertical axes of rotation.

8. The raise buggy of claim 2 wherein said drilling platform comprises a primary platform corresponding in dimension to cross-sectional dimensions of said cabinet and platform extensions selectively extendable from said primary platform so as to provide an extended generally planar drilling platform extending substantially a cross-sectional distance between said opposed side walls of said raise and substantially between said raise floor and a raise ceiling.

9. The raise buggy of claim 8 wherein said selectively extendable drilling platform extensions are hingedly mounted to said primary drilling platform for rotation from a storage position folded onto and lying upon said primary drilling platform and an open position adjacent to and generally co-planar with said primary drilling platform.

10. The raise buggy of claim 8 wherein said selectively extendable drilling platform extensions having selectively extendable rigid members on which may be laid scaffolding members.

11. The raise buggy of claim 2 further comprising a rigid ratchet member, pivotally mounted to said cabinet for free pivotal movement, in a generally vertical generally longitudinally aligned plane, relative to said cabinet adapted so that said pivotal movement engages said rigid ratchet member with a rigid ladder extending longitudinally along, and mounted to, said raise floor.

12. The raise buggy of claim 11 wherein said rigid ratchet member is pivotally mounted to an underside of said cabinet.

13. The raise buggy of claim 12 comprising a plurality of said rigid ratchet members.

* * * * *